US011885190B2

(12) United States Patent
Hansen et al.

(10) Patent No.: US 11,885,190 B2
(45) Date of Patent: Jan. 30, 2024

(54) APPARATUS AND METHOD TO LONGITUDINALLY AND CIRCUMFERENTIALLY CUT AND REMOVE A SECTION OF A WELLBORE TUBULAR

(71) Applicants: AARBAKKE INNOVATION, A.S., Bryne (NO); PETROLIAM NASIONAL BERHAD, Kuala Lumpur (NO)

(72) Inventors: Henning Hansen, Sirevåg (NO); Tarald Gudmestad, Nærbo (NO); Luqmanul Shafiee, Ampnag Selango (MY); Siti Rahman, Subang Jaya (MY)

(73) Assignee: AARBAKKE INNOVATION, A.S., Bryne (NO)

( * ) Notice: Subject to any disclaimer, the term of this patent is extended or adjusted under 35 U.S.C. 154(b) by 195 days.

(21) Appl. No.: 17/478,459

(22) Filed: Sep. 17, 2021

(65) Prior Publication Data

US 2022/0074279 A1 Mar. 10, 2022

Related U.S. Application Data

(63) Continuation of application No. PCT/IB2020/052426, filed on Mar. 17, 2020.
(Continued)

(51) Int. Cl.
*E21B 29/06* (2006.01)
*E21B 4/18* (2006.01)
(Continued)

(52) U.S. Cl.
CPC ..... *E21B 29/06* (2013.01); *E21B 4/18* (2013.01); *E21B 23/01* (2013.01); *E21B 29/02* (2013.01)

(58) Field of Classification Search
CPC ..... E21B 29/02; E21B 29/06; E21B 4/18; E21B 23/01
(Continued)

(56) References Cited

U.S. PATENT DOCUMENTS 3,750,748 A * 8/1973 Kinley ..... E21B 29/00 166/377
5,320,174 A * 6/1994 Terrell ..... E21B 43/114 166/55
(Continued)

FOREIGN PATENT DOCUMENTS

WO 20140117846 A1 8/2014
WO 20150175025 A1 11/2015

OTHER PUBLICATIONS

Malaysian Substantive Examination Clear Report dated Jun. 9, 2022, for Malaysian Patent Application No. PI 2016704189.
(Continued)

*Primary Examiner* — Taras P Bemko
(74) *Attorney, Agent, or Firm* — Richard A. Fagin

(57) ABSTRACT

An apparatus for cutting sections of a wellbore tubular includes a housing shaped to enable movement along an interior of the tubular. The housing has an upper end arranged to connect to a conveyance and a lower end comprising a guide. Cutting materials are disposed in the housing and arranged to cut the wellbore tubular in two, longitudinally spaced apart circumferential cuts and at least one longitudinal cut extending between the circumferential cuts. The cutting materials are arranged to create the circumferential cuts simultaneously or with a time delay chosen to optimize energy created when cutting. A method for cutting wellbore tubulars includes positioning the apparatus at a selected position in the wellbore and actuating the cutting materials.

14 Claims, 6 Drawing Sheets

Related U.S. Application Data

(60) Provisional application No. 62/819,824, filed on Mar. 18, 2019.

(51) Int. Cl.
*E21B 23/01* (2006.01)
*E21B 29/02* (2006.01)

(58) Field of Classification Search
USPC ..... 166/55
See application file for complete search history.

(56) References Cited

U.S. PATENT DOCUMENTS

| | | | | |
|---|---|---|---|---|
| 5,575,331 | A | 11/1996 | Terrell | |
| 5,765,756 | A | 6/1998 | Jordan et al. | |
| 2007/0251692 | A1 | 11/2007 | Billingham | |
| 2014/0352964 | A1* | 12/2014 | Surjaatmadja | E21B 29/06 73/865.9 |
| 2015/0233218 | A1 | 8/2015 | Morten et al. | |
| 2015/0321290 | A1 | 11/2015 | Zediker et al. | |
| 2015/0345245 | A1* | 12/2015 | Bell | F42B 3/006 102/310 |
| 2017/0030157 | A1* | 2/2017 | Hansen | E21B 43/12 |
| 2017/0122082 | A1* | 5/2017 | Lin | B26D 3/16 |
| 2020/0208485 | A1* | 7/2020 | Hoelscher | F42B 1/032 |

OTHER PUBLICATIONS

Second examination report from Australian Application No. 202043600, dated Oct. 24, 2022.
First examination report from Australian Application No. 202043600, dated Aug. 22, 2022.
International Search Report, International Application No. PCT/IB2020/052426 dated Jul. 17, 2020.
Written Opinion of the International Search Authority, International Application No. PCT/IB2020/052426 dated Jul. 17, 2020.
European Examination report dated Dec. 13, 2022, for European Application No. 20720929.7.
Canadian Office Action dated Dec. 13, 2022, for Canadian Application No. 3,131,092.
Canadian Office Action dated Jul. 12, 2023, for Canadian Application No. 3,131,092.
Examination Report pursuant to Article 94(3) EPC dated Aug. 30, 2023, for European Patent Application No. 20720929.7.

* cited by examiner

APPARATUS AND METHOD TO LONGITUDINALLY AND CIRCUMFERENTIALLY CUT AND REMOVE A SECTION OF A WELLBORE TUBULAR

CROSS REFERENCE TO RELATED APPLICATIONS

Continuation of International Application No. PCT/IB2020/052426 filed on Mar. 17, 2020. Priority is claimed from U.S. Provisional Application No. 62/819,824 filed on Mar. 18, 2019. Both the foregoing applications are incorporated herein by reference in their entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

This disclosure relates to the field of abandonment of subsurface wells. More specifically, the disclosure relates to cutting and removing sections of wellbore tubular elements, e.g., casing and tubing, during a procedure to plug and abandon a subsurface well.

Permanent wellbore abandonment includes so-called plug and abandonment (P&A) procedures. Such procedures are used for prevention of fluid leaks into the environment and subsequent contamination of other underground areas and are important for preventing future costly repairs, environmental remediation and damage to the business reputation of the well owner, among other characteristics. It is observed in the oil and gas industry that high importance is placed on setting and verifying in-well ("downhole") fluid barriers, while lowering the cost of the abandonment by performing increasing amounts of abandonment work using small, lightweight and less costly wellbore intervention equipment rather than the use of larger footprint, costly to operate well drilling units.

Possible leaks outside and between wellbore conduit ("tubulars") installed in a well must be prevented, and therefore existing barriers must be verified or new barriers need to be established and verified, prior to permanently leaving the tubulars in the ground at the time the well is to be abandoned. Typically, a production tubing string (a nested conduit inside a wellbore casing) is pulled out of the well to enable good placement and verification of barriers within or externally to the wellbore casing, that is, the conduit or tubular generally adjacent to the originally drilled wellbore. Such barriers may comprise cement placed in an annular space between the casing and the drilled borehole. Barrier verification may comprise making measurements such as acoustic cement bond verification. However, handling and disposal of used production tubing is typically a health, safety and environmental (HSE) challenge; the tubing can be costly to pull out of the well, transport, unload and dispose, etc. Therefore, being able to permanently seal in and leave production tubing in a well as part of abandonment has significant advantages with respect to HSE risk and cost. If a section of wellbore tubular can be removed even if only to provide access for barrier verification and establishment, that will be an advantage.

At present, there are no wellbore intervention technologies available that can provide reliable information about barrier condition through two nested tubular strings, e.g., a tubing within a casing. If the inner nested tubular (e.g., tubing) is removed, then the current intervention technologies can be deployed to perform measurement (logging) through the one remaining tubular (e.g., casing). However, as explained above, removing tubing can be difficult and expensive.

SUMMARY

An apparatus for cutting sections of a wellbore tubular according to one aspect of the present disclosure includes a housing shaped to enable movement along an interior of the wellbore tubular. The housing has an upper end arranged to connect to a conveyance and a lower end comprising a guide. Cutting materials are disposed in the housing and are arranged to cut the wellbore tubular in at least one circumferential cut and at least one longitudinal cut.

In some embodiments, the cutting materials comprise explosive cutters.

In some embodiments, the cutting materials comprise chemical cutters.

In some embodiments, the housing comprises at least one push-out module.

Some embodiments further comprise at least one of a push-out module and a push in module disposed between the upper end and the guide and is arranged to contact the tubular to at least one of radially expand the tubular and radially contract the tubular.

In some embodiments, the at least one push out module comprises a hydraulic ram/cylinder combination.

Some embodiments further comprise a plurality of longitudinally spaced apart push out modules.

In some embodiments, the cutting materials are arranged to cut the wellbore tubular along a plurality of longitudinal cuts extending between the circumferential cuts.

Some embodiments further comprise a push down module. The push down module comprises at least one radially extensible arm for engaging a longitudinal end of a wellbore tubular severed by the cutting materials.

In some embodiments, the at least one arm is urged radially outward from the housing by a biasing device.

In some embodiments, the biasing device comprises a spring.

In some embodiments, the cutting materials are arranged to cut the wellbore tubular in at least a second circumferential cut longitudinally spaced apart from the at least one circumferential cut by a distance corresponding to a length of the at least one longitudinal cut.

A method for cutting a wellbore tubular according to another aspect of the disclosure comprises positioning a tool in the wellbore tubular at a selected depth. The tool comprises a housing shaped to enable movement along an interior of the wellbore tubular. The housing has an upper end arranged to connect to a conveyance and a lower end comprising a guide. Cutting materials disposed in the housing are arranged to cut the wellbore tubular in two, longitudinally spaced apart circumferential cuts and at least one longitudinal cut extending between the circumferential cuts.

Some embodiments further comprise actuating the cutting materials to create a plurality of longitudinal cuts in the wellbore tubular.

Some embodiments further comprise at least one of a push-out module and a push in module is disposed between the upper end and the guide and arranged to contact the tubular to at least one of radially expand the tubular and radially contract the tubular.

Some embodiments further comprise actuating the push-out module to radially expand the wellbore tubular to enable dropping the cut section over the wellbore tubular below the lower circumferential cut.

Some embodiments further comprise conducting at least one well intervention operation through an opening created by cutting the wellbore tubular.

In some embodiments, the push-out module and a pull in module is operated with sufficient force to lift the tubular from a wall of a conduit in which the tubular is nested.

Some embodiments further comprise moving a push down module to a position above a position of a tubular severed by the actuating the cutting materials. The push down module comprises at least one radially extensible arm for engaging a longitudinal end of a wellbore tubular severed by the cutting materials.

In some embodiments, the at least one arm is urged radially outward from the housing by a biasing device.

In some embodiments, the biasing device comprises a spring.

Some embodiments further comprise actuating further cutting materials to make at least one additional longitudinal cut beginning at a longitudinal end of severed wellbore tubular and actuating the further cutting materials to make at least one additional circumferential cut proximate a longitudinal end of the at least one additional longitudinal cut.

Other aspects and possible advantages will be apparent from the description and claims that follow.

DETAILED DESCRIPTION

Chemical and explosive cutting of very short longitudinal sections, typically less than a meter both longitudinally and circumferentially, are commonly performed by a number of technologies, and have been used in the oil and gas industry for many decades. Examples of such technologies including cutting devices, some of which are described in U.S. Pat. No. 8,561,683 issued to Wood and U.S. Pat. No. 5,320,174 issued to Terrell. These technologies will only provide one cut, typically to pull a tubular apart or provide a hydraulic communication path between the inside and the outside of the cut tubular. Herein are described a method and apparatus for removing a section of a wellbore tubular by longitudinal and circumferential cutting of the tubular, followed by pushing or pulling the cut sections away from the uncut tubular below and/or above the cut portion so that the cut portions are able to drop into the wellbore below a lowermost circumferential cut. A tool to perform such cutting may be designed such that the lower part of the tool protrudes below the lowest circumferential cut, and enables the tool to laterally lift the remaining, cut tubular clear of the inner wall of an externally disposed, nested tubular.

Figure 1:
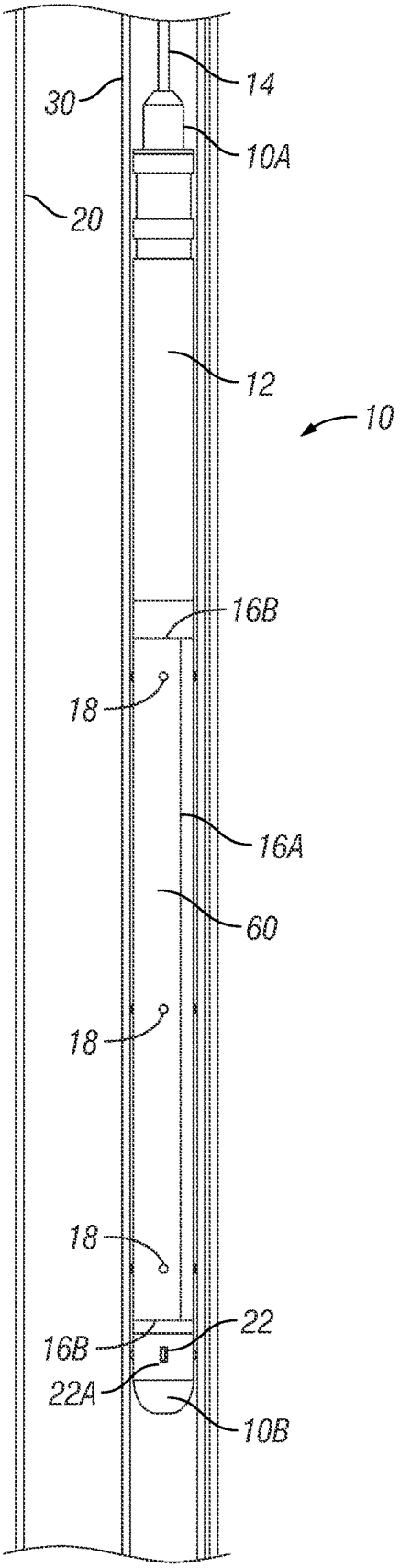
FIG. 1 illustrates a wellbore intervention tool for longitudinal and circumferential tubular slicing and cutting.

FIG. 1 illustrates a wellbore intervention tool 10 that can be deployed by a conveyance, e.g., an electric cable 14 (wireline) as shown, by a spoolable, semi-stiff rod having electrical power and signal capabilities, or by coiled tubing having an electric cable implemented. As shown in FIG. 1, the wellbore intervention tool 10 may be deployed into a tubing 30 having an external diameter of, for example, 3½ inches (89 cm). The tubing 30 may be nested within a casing 20 having an external diameter of 9⅝ inches (245 cm). Those skilled in the art will appreciate that the above casing and tubing dimensions are only example dimensions, and such dimensions will vary from well to well. Accordingly, such dimensions are not to be construed as a limit on the scope of the present disclosure; any other dimensions for wellbore tubulars are within the scope of the present disclosure.

The wellbore intervention tool 10 may comprise, in its upper section, a cable head 10A or similar connector for electrical and mechanical connection to a deployment device (e.g., an armored electrical cable 14), and optionally an emergency release (associated with the cable head 10A, not shown separately). A guide nose 10B may be disposed in the lower end of the wellbore intervention tool 10. An actuation module 12 forming part of the wellbore intervention tool 10 may comprise control circuits (not shown separately) for actuating explosive and/or chemical cutting materials and actuating one or more push-out modules 18.

The cutting materials may be disposed, for example, in a cutting materials module 60. The placement of the cutting materials in such cutting materials module 60 may be chosen according to intended cut pattern of the tubular in which the wellbore intervention tool 10 is deployed. The present example embodiment contemplates a combination of cutting materials arranged on the wellbore intervention tool 10 for both longitudinal and circumferential cutting. The circumferential and longitudinal cuts may be performed simultaneously, or with a chosen time delay between them to optimize the energy created when cutting. In the example embodiment shown in FIG. 1, two circumferential cutter discharge ports 16B may provide that the cutting materials create longitudinally spaced apart, circumferential cuts in the tubing 30 (or other well tubular) when actuated. A longitudinal cutter discharge port 16A may enable making a longitudinal cut in the tubing 30 that extends between the circumferential cuts made through the circumferential discharge ports 16A. Thus, when a section of a wellbore tubular (e.g., the tubing 30) is cut, at least one longitudinal cut and two circumferential cuts are made using the illustrated embodiment. Other embodiments may comprise two or more such longitudinal discharge ports 16A disposed at circumferentially spaced apart positions to create two or more such longitudinal cuts in the tubular.

In some embodiments, such as the embodiment shown in FIG. 1, the wellbore intervention tool 10 may comprise one or more push-out modules 18. Three such modules are shown in FIG. 1, each comprising apparatus that can extend laterally and push outward against the tubular (e.g., tubing 30) in which the wellbore intervention tool 10 is deployed. The push-out modules 18 may comprise any mechanism to extend laterally from the wellbore intervention tool 10 and retract, for example and without limitation, hydraulic ram/cylinder combinations, motor/jack screw combinations or any similar devices. The push-out modules 18 may be extended after deploying the wellbore intervention tool 10 to a required operating depth, or such modules 18 may be activated after initiating tubular cutting operations. The push-out modules 18 may comprise rollers, wheels or similar devices on their extending elements to reduce friction between the push-out modules 18 and the interior wall of the tubular (e.g., tubing 30). In wellbores where there is sufficient annular clearance available between nested tubulars (casing 20 and tubing 30), the push-out modules 18 may be substituted by pull-in modules which pull cut tubular sections inward into the interior of the cut tubular, followed by release and dropping of the cut tubular sections into the tubular below the depth of the wellbore intervention tool 10. Selectively activating the various push-out or pull-in modules is possible, where for example, the lowermost push-out/pull in module(s) may be activated first followed by activation of the push-out/pull module(s) above or by activating the uppermost push-out/pull module(s) first followed by the lower push-out/pull module(s), etc. Pull-in modules may comprise electromagnets, tubular wall penetrating "spears", suction cups or similar devices that can attach to or otherwise affix to the tubular and urge such tubular toward the wellbore intervention tool 10 when the pull in module is retracted. Although the devices shown in FIG. 1 and explained above are described as "modules", it is within the scope of the present disclosure to provide apparatus capable of the above described push out and/or pull in functions in any form that can be conveyed with the wellbore intervention tool 10, whether or not such apparatus is in modular in form.

In the present example embodiment, the push-out module(s) 18 when actuated may spread the tubular (e.g., tubing 30) along the longitudinal cuts after the cutting materials are actuated. A wellbore intervention tool as shown in FIG. 1 may be used as further explained below.

In the present example embodiment, the push out module(s) 18 may be disposed longitudinally along the wellbore intervention tool 10 between the spaced apart circumferential discharge ports 16B.

Other embodiments may omit the push-out and/or pull in modules entirely, having only the cutting materials module 60. In such embodiments, the functions performed by the push our or pull in modules may be performed by a separate wellbore intervention tool.

Some embodiments of the wellbore intervention tool may comprise only one circumferential discharge port 16B. Such embodiments may be used, among other purposes, to sever additional segments of wellbore tubular as will be further explained below.

The present example embodiment may comprise a guide 22 on the longitudinal end opposite the end connected to the cable 14. The guide 22 may comprise one or more rollers 22A to reduce friction when the wellbore intervention tool 10 is moved along the interior of a wellbore tubular.

Figure 2:
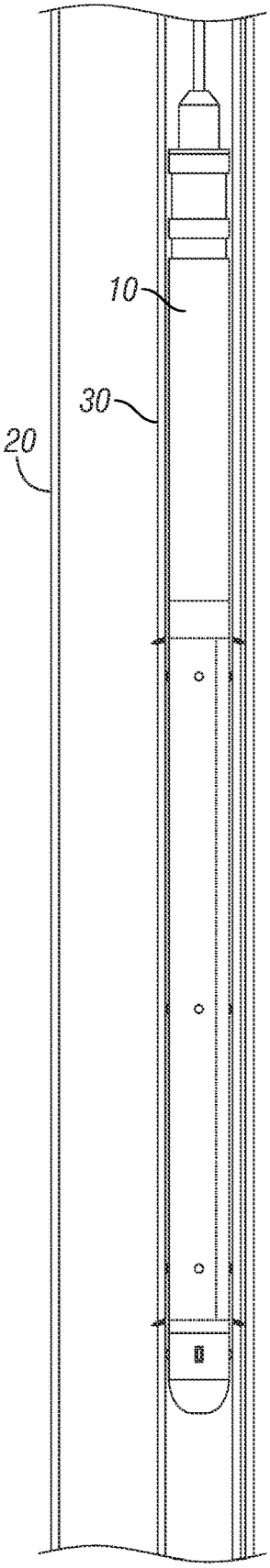
FIG. 2 illustrates the wellbore intervention tool deployed to depth where the tubular cutting and slicing is initiated.

FIG. 2 illustrates the wellbore intervention tool 10 deployed to a chosen depth where tubular cutting is to be performed.

Figure 3:
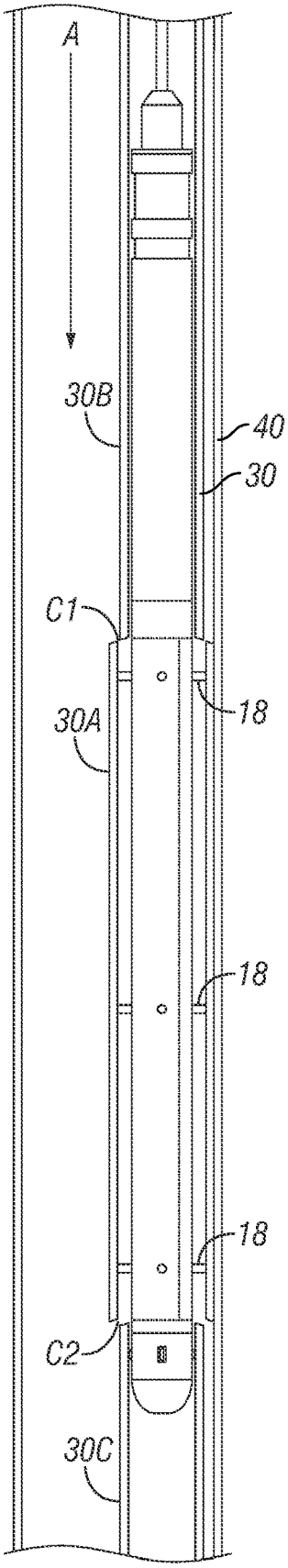
FIG. 3 illustrates that the longitudinal and circumferential cuts has been completed, followed by the push-out of the cut out tubular sections.

FIG. 3 illustrates that a longitudinal cut (see L in FIG. 7) and circumferential cuts, C1, C2, respectively have been completed by actuating the cutting materials in the cutting material module 20, followed by operation, in this case by extension of the push-out modules 18. Extension of the push-out modules 18 after cutting the tubular (e.g., tubing 30) will result in the cut-out section 30A being radially expanded toward the surrounding casing 20, while the tubing 30 above and below the cuts C1, C2 will be laterally moved (lifted in an inclined well) away from the casing 20. Such movement will allow the cut tubing section 30A to be dropped outside the upper end of the remaining uncut tubing 30C, located below the cut section (i.e., below cut C2 in FIG. 3). Because no wellbore is perfectly vertical, a tubing string will generally rest against the interior wall of the surrounding casing where no tubing centralizer or other annular element (in annular space A) is present. If the part of the tubing collocated with the wellbore intervention tool inside was not lifted away from the casing, one or several of the cut-out sections would not be able drop down outside the tubing string below the cut C2 and into the annular space A.

Figure 4:
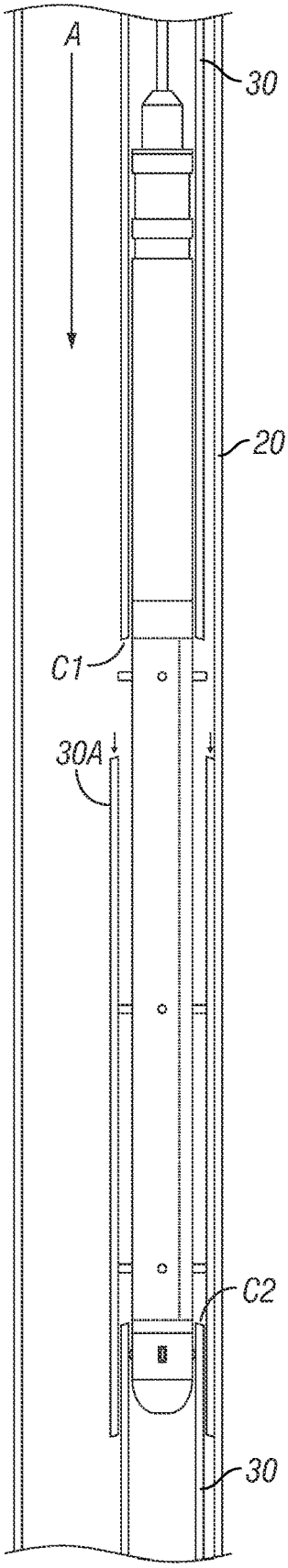
FIG. 4 illustrates that the cut out tubular sections is sliding or dropping down into the wellbore, externally of the tubular where the cut was made.

FIG. 4 illustrates that the cut out tubular section 30A is sliding or dropping down into the well, external to the tubing 30 below where the lower circumferential cut C2 was made, and thus into the annular space A.

Figure 5:
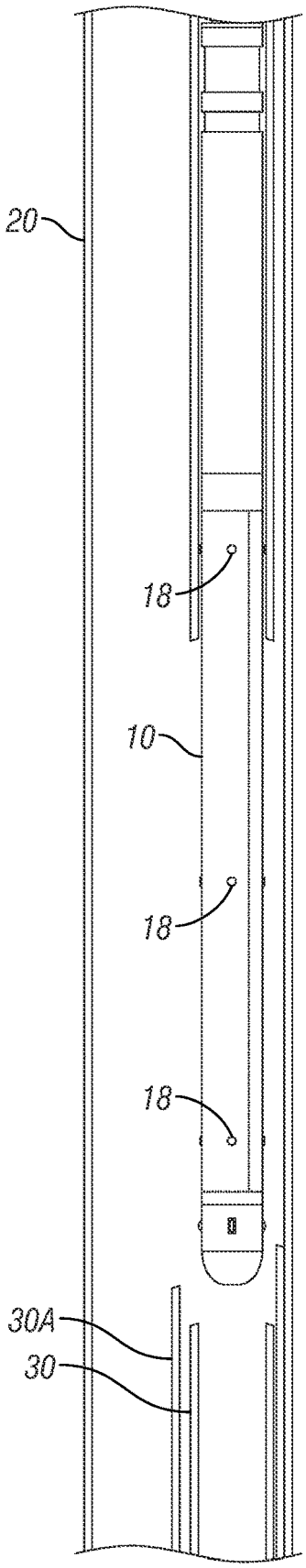
FIG. 5 illustrates that the cut tubular sections has dropped down, and that the intervention tool can be retrieved to the surface.

FIG. 5 illustrates that the cut tubular section 30A has dropped down, the push-out modules 18 have been retracted, and that the wellbore intervention tool 10 can be retrieved to the surface, e.g., by retracting the cable (14 in FIG. 1).

Figure 6:
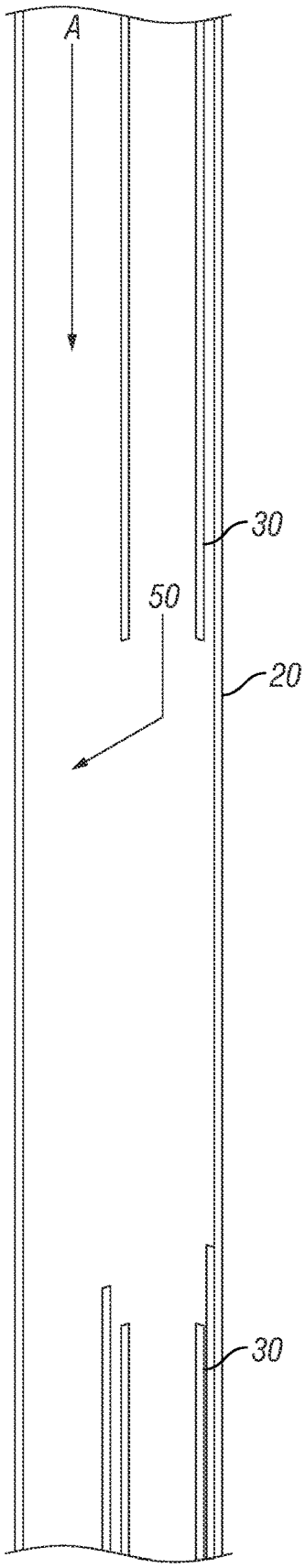
FIG. 6 illustrates the intervention tool removed, and that a section of tubular has been removed to provide access to an outer tubular.

FIG. 6 illustrates the wellbore intervention tool 10 has been removed from the tubing 30, and that a section of well tubular (tubing 30) has been removed so that access along a path 50 to the interior of the outer tubular (casing 20) is provided for logging instruments and other required intervention tools. In some embodiments, following cutting the wellbore tubular as explained herein, at least one wellbore intervention operation may be conducted in the annular space A through the path 50. Such operation may comprise, e.g., wireline logging, among other operations.

Figure 7:
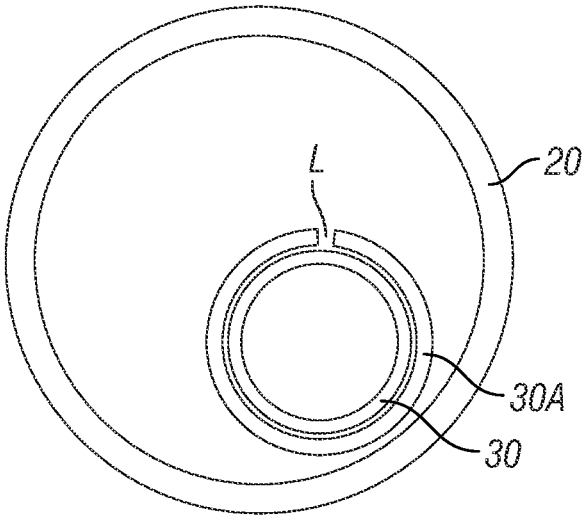
FIG. 7 illustrates a method where the tubular has one longitudinal split, where the tubular is expanded to a size large enough to be dropped or pushed over a tubular located below.

FIG. 7 illustrates an example embodiment of a method where the tubular has only one longitudinal cut L, where the cut section of tubular 30A is radially expanded to a size large enough to be dropped or pushed over the cut tubular (e.g., tubing 30) located below the lower circumferential cut (C2 in FIG. 3).

The above operations may be repeated any number of times, so that required lengths of tubulars are removed. One tubular section may be of a length of, for example, 10-12 meters, while there may be requirements to remove up to 100 meters of tubular. A tool as herein described may also be configured for longer than 10-12 meter cuts, e.g., by increasing the longitudinal spacing between the circumferential discharge ports (16A in FIG. 1).

Figure 8:
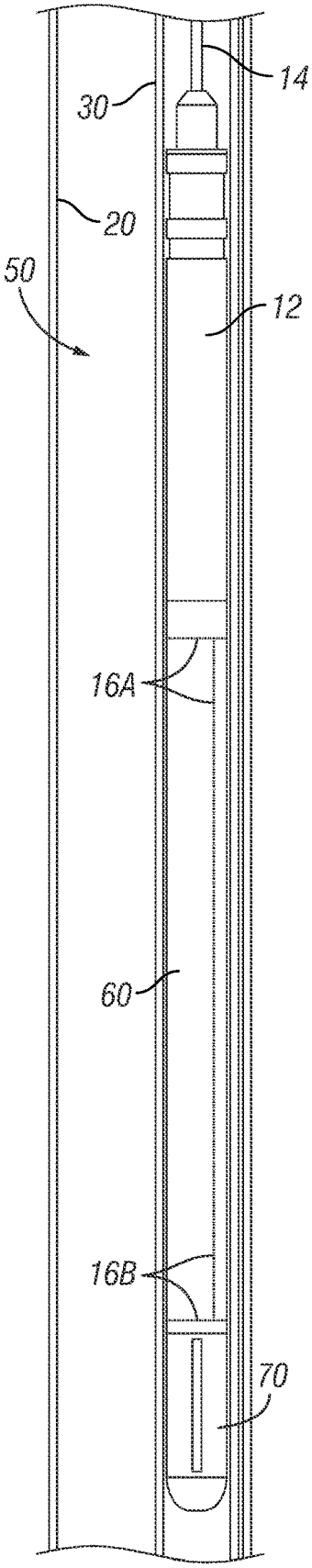
FIG. 8 shows another example embodiment of a wellbore intervention tool.

FIG. 8 shows another example embodiment of the wellbore intervention tool 10. The present example embodiment of the wellbore intervention tool 10 may be similarly configured as the embodiment explained with reference to FIG. 1 but with the following differences. The present example embodiment of the wellbore intervention tool 10 may comprise, instead of the guide (22 in FIG. 1) at one longitudinal end, a push down module 70. The push down module 70 may comprise components, to be explained further below, that engage the top of a severed wellbore tubular to enable the wellbore intervention tool to apply axial force to the severed section in order to move it away from the remainder of the wellbore tubular. The present example embodiment may omit the one or more push out (or pull in) modules explained above (18 in FIG. 1

Figure 9:
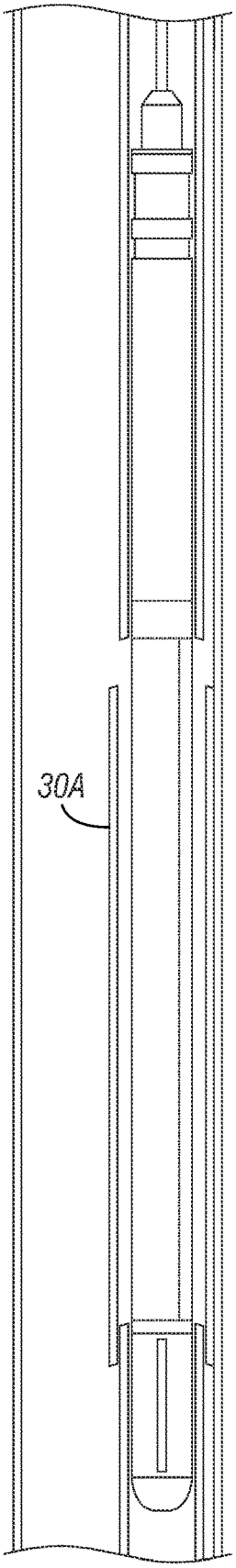
FIG. 9 shows the example embodiment of FIG. 8 wherein a wellbore tubular is cut.

FIG. 9 shows the example embodiment of FIG. 8 wherein a wellbore tubular is cut. In this case, the cut tubular is tubing 30, as in the previously explained embodiments. Actuation of the cutting materials in the cuttings material module 60 may make two or more longitudinally spaced apart circumferential cuts in the tubing 30 (or any other wellbore tubular to be severed). Shock wave from detonating the cutting materials may expand the severed section 30A of the wellbore tubular 30 radially so that it is larger in expanded diameter than the outer diameter of the remainder of the wellbore tubular.

Figure 10:
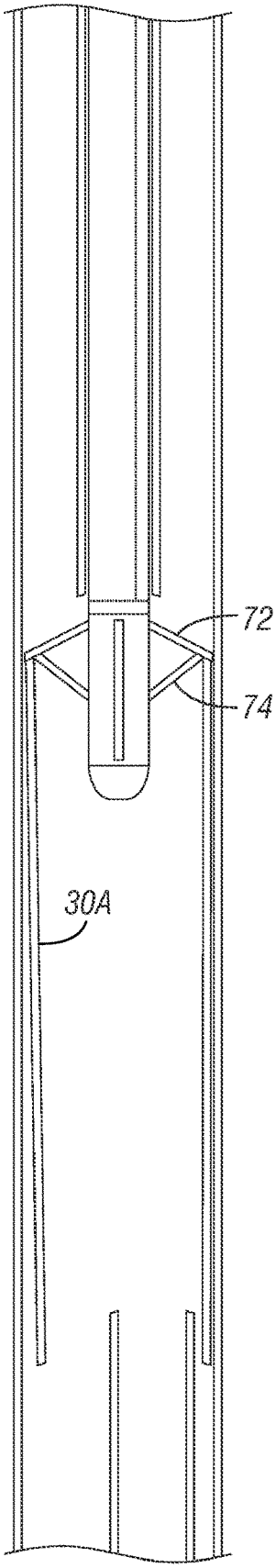
FIG. 10 shows the example embodiment of FIG. 8 lifted above the cut tubular in FIG. 9 to deploy a push down module.

FIG. 10 shows the example embodiment of FIG. 8 lifted above the severed tubular 30A in FIG. 9 to deploy the push down module 70. The push down module 70 may comprise one or more arms 72 pivotally coupled to the wellbore intervention tool 10. Each arm 72 may be urged to radially extend from the wellbore intervention tool 10 by a biasing device 74 such as a spring or hydraulic cylinder. When the wellbore intervention tool 10 is axially moved above the severed tubular 30A, the arm(s) 72 extend radially as shown in FIG. 10 to enable engagement of the extended arm(s) 72 with the top of the severed tubular 30A. The wellbore intervention tool 10 may then be moved downward in the well to urge the severed tubular 30A downward in the annular space A.). Although the push down module 60 is shown proximate the lower end of the wellbore intervention tool 10, for purposes of defining the scope of the present disclosure, it is only necessary that the push down module 60 be located so that the arm 72 remains compressed until which time it is desired to radially expand the arm 72 to enable push down of the severed wellbore tubular. For example, in a wellbore intervention tool such as shown in FIG. 8, the push down module 60 could be located axially proximate the actuator module 12. Thus, severing the wellbore tubular would not immediately result in radial expansion of the arm 72. By moving such embodiment of the wellbore intervention tool downward below the position at which the upper circumferential cut is made, the arm 72 will expand radially such that it engages the top of the severed section 30A of the wellbore tubular.

Figure 11:
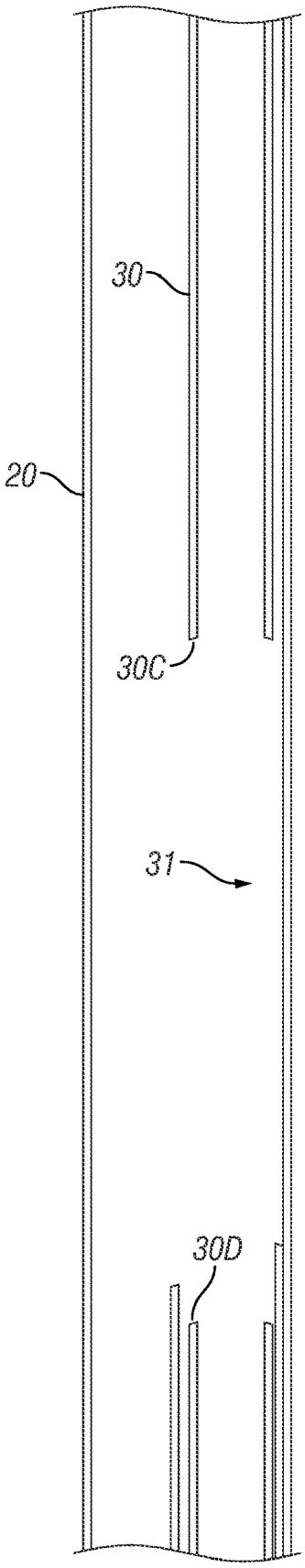
FIG. 11 shows the well of FIGS. 8 through 10 wherein cut tubular has been pushed out of the way to leave an opening in the wellbore tubular.

FIG. 11 shows the well of FIGS. 8 through 10 wherein the cut tubular 30A has been pushed out of the way to leave an opening 31 in the wellbore tubular 30. The opening 31 may provide access to the interior wall of the tubular, e.g., the casing 20, in which the wellbore tubular 30 is nested for subsequent intervention operations such as logging or perforating.

In the present example embodiments, the severed tubular may be deformed or pushed outward into the annular space 50 by energy from operation of the cutting materials. Such outward pushing may enable severed segments of the tubular (e.g., tubing 30) to drop below the upper end 30D in FIG. 11 of the lower part of the severed tubular, either by gravity alone or using the push down module as explained with reference to FIGS. 8 through 10.

In some embodiments, and as explained with reference to FIG. 1, may comprise only one circumferential discharge port 16B. Such embodiments may be configured as explained with reference to FIG. 1 or FIG. 8. Such embodiments may be used to sever additional segments of tubular, for example, by making one or more longitudinal cuts in the tubular from the bottom 30C of the several tubular 30 extending upwardly, or from the top 30D of the severed tubular extending downwardly. Such longitudinal cut(s) may be accompanied by a circumferential cut proximate the longitudinal end of the longitudinal cut(s) to sever an additional segment of the tubular 30. The foregoing procedure may be repeated until a chosen length of the tubular 30 is severed and displaced.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. An apparatus for cutting sections of a wellbore tubular, comprising:

a housing shaped to enable movement along an interior of the wellbore tubular, the housing having an upper end arranged to connect to a conveyance and a lower end comprising a guide;

cutting materials disposed in the housing and arranged to cut the wellbore tubular in two, longitudinally spaced apart circumferential cuts and at least one longitudinal cut extending between the circumferential cuts, wherein the cutting materials are arranged to create the circumferential cuts and the at least one longitudinal cut simultaneously; and at least one of a push-out module and a push in module disposed between the upper end and the guide and arranged to contact the tubular to at least one of radially expand the tubular and radially contract the tubular.

2. The apparatus of claim 1 wherein the cutting materials comprise explosive cutters.

3. The apparatus of claim 1 wherein the cutting materials comprise chemical cutters.

4. The apparatus of claim 1 wherein the at least one push out module comprises a hydraulic ram/cylinder combination.

5. The apparatus of claim 1 further comprising a plurality of longitudinally spaced apart push out modules.

6. The apparatus of claim 1 wherein the cutting materials are arranged to cut the wellbore tubular along a plurality of longitudinal cuts extending between the circumferential cuts.

7. A method for cutting a wellbore tubular, comprising:

positioning a tool in the wellbore tubular at a selected depth, the tool comprising a housing shaped to enable movement along an interior of the wellbore tubular, the housing having an upper end arranged to connect to a conveyance and a lower end comprising a guide; cutting materials disposed in the housing and arranged to cut the wellbore tubular in two, longitudinally spaced apart circumferential cuts and at least one longitudinal cut extending between the longitudinally spaced apart circumferential cuts;

actuating the cutting materials, wherein the cutting materials are actuated to create the circumferential cuts and the at least one longitudinal cut simultaneously; and actuating at least one of a push-out module or a pull in module to radially expand or contract the cut wellbore tubular to enable dropping a cut section over the wellbore tubular below the lower circumferential cut.

8. The method of claim 7 further comprising actuating the cutting materials to create a plurality of longitudinal cuts in the wellbore tubular.

9. The method of claim 7 wherein the actuated at least one of a push-out module or a pull in module is operated with sufficient force to laterally lift the tubular from a wall of a conduit in which the tubular is nested.

10. The method of claim 7 further comprising conducting at least one well intervention operation through an opening created by cutting the wellbore tubular.

11. An apparatus for cutting sections of a wellbore tubular, comprising:

a housing shaped to enable movement along an interior of the wellbore tubular, the housing having an upper end arranged to connect to a conveyance and a lower end comprising a guide;

cutting materials disposed in the housing and arranged to cut the wellbore tubular in a plurality of longitudinally spaced apart circumferential cuts, and a plurality of longitudinal cuts extending between adjacent ones of the plurality circumferential cuts, wherein the cutting materials are arranged to create the plurality circumferential cuts simultaneously or with a time delay chosen to optimize energy created when cutting; and a plurality of longitudinally spaced apart push out modules or pull in modules disposed between the upper end and the guide and arranged to contact the tubular to radially expand the tubular or to radially contract the tubular.

12. The apparatus of claim 11 wherein the cutting materials comprise explosive cutters.

13. The apparatus of claim 11 wherein the cutting materials comprise chemical cutters.

14. The apparatus of claim 11 wherein the plurality of push out modules each comprises a hydraulic ram/cylinder combination.

* * * * *